US008503892B2

(12) United States Patent
Sakaya et al.

(10) Patent No.: US 8,503,892 B2
(45) Date of Patent: Aug. 6, 2013

(54) DEVELOPING UNIT, IMAGE FORMING APPARATUS, AND PROCESS CARTRIDGE

(75) Inventors: Kohta Sakaya, Osaka (JP); Tomohiro Kubota, Osaka (JP); Tetsumaru Fujita, Hyogo (JP); Atsushi Takehara, Kyoto (JP); Naoki Nakatake, Hyogo (JP)

(73) Assignee: Ricoh Company, Limited, Tokyo (JP)

( * ) Notice: Subject to any disclaimer, the term of this patent is extended or adjusted under 35 U.S.C. 154(b) by 318 days.

(21) Appl. No.: 13/013,224

(22) Filed: Jan. 25, 2011

(65) Prior Publication Data

US 2011/0188896 A1 Aug. 4, 2011

(30) Foreign Application Priority Data

Feb. 4, 2010 (JP) ..... 2010-022705

(51) Int. Cl.
*G03G 15/08* (2006.01)

(52) U.S. Cl.
USPC ..... 399/27; 399/119; 399/149; 399/222

(58) Field of Classification Search
USPC ..... 399/27, 119, 149, 222
See application file for complete search history.

(56) References Cited

U.S. PATENT DOCUMENTS

| | | | | |
|---|---|---|---|---|
| 5,036,363 | A * | 7/1991 | Iida et al. | 399/30 |
| 2005/0008402 | A1* | 1/2005 | Mizutani et al. | 399/281 |
| 2005/0123324 | A1* | 6/2005 | Kawano et al. | 399/281 |
| 2008/0145108 | A1 | 6/2008 | Yoshida et al. | |
| 2009/0067887 | A1 | 3/2009 | Fujita et al. | |
| 2009/0169265 | A1 | 7/2009 | Yoshida et al. | |

FOREIGN PATENT DOCUMENTS

| | | |
|---|---|---|
| JP | 11-237772 | 8/1999 |
| JP | 4026977 | 10/2007 |
| JP | 2009-156951 | 7/2009 |

* cited by examiner

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A developing unit includes: a developer carrier; a toner supplying member having a porous surface layer; a toner storage storing therein toner; a stirring member that is rotated to stir the toner; a toner amount detecting unit that detects an amount of the toner; a toner supplying unit that supplies new toner to the toner storage based on a detection result; and a toner removing member that removes the toner carried in the porous surface layer, wherein the toner removing member is arranged in a separable and contactable manner from and with the porous surface layer, and the developing unit has a stirring mode in which the toner removing member is brought into contact with the porous surface layer, and the toner supplying member is rotated while the stirring member is rotated to stir the toner.

18 Claims, 5 Drawing Sheets

DEVELOPING UNIT, IMAGE FORMING APPARATUS, AND PROCESS CARTRIDGE

CROSS-REFERENCE TO RELATED APPLICATIONS

The present application claims priority to and incorporates by reference the entire contents of Japanese Patent Application No. 2010-022705 filed in Japan on Feb. 4, 2010.

BACKGROUND OF THE INVENTION

1. Field of the Invention

The present invention relates to a developing unit included in an image forming apparatus such as a copying machine, a facsimile, and a printer, and to an image forming apparatus and a process cartridge having the developing unit.

2. Description of the Related Art

Electrophotographic image forming apparatuses are being demanded to provide higher image quality, as well as to be smaller in size and to have a longer lifetime. As the lifetime of a developing unit is extended, a large amount of toner is to be consumed. However, if a space for storing therein a large amount of toner is reserved in the developing unit, the size of the developing unit will be increased. Furthermore, if the amount of the toner stored in the developing unit is increased, more frictional heat is generated in stirring the toner. Accumulated heat could cause the toner resin to melt and to clump together, and might result in deterioration of image quality. Moreover, although the toner has a granularity distribution spreading across a certain range, the toner granules with smaller diameters tend to be consumed earlier in the development. Thus, the toner granules with larger diameters, not consumed while the development is performed repeatedly, are left behind, and the large-diameter toner granules come to occupy a larger ratio in the toner stored in the developing unit. If the development is performed using the toner having a granularity distribution shifted toward larger diameters, image quality might be deteriorated. If more toner is stored in the developing unit, because the development is repeatedly performed over a long time period without supplying toner containing granules having smaller diameters, image formation tends to be continued in a defective manner, using the toner with the increased ratio of larger diameter granules.

For the reasons described above, it is preferable to reduce the amount of the toner stored in the developing unit as much as possible within a range allowing high quality development. To this end, in a mainstream structure, the space for storing therein toner is reduced in the developing unit, and a toner container containing new toner is mounted replaceably on the developing unit, so that the toner is supplied from the toner container when the level of the toner remaining in the development unit becomes low.

Widely known as a developing unit to which toner is supplied in the manner described above is a single component developing unit including a developing roller, a supplying roller that carries toner, supplies the toner to the developing roller and collects the toner not used in the development from the developing roller, a toner storage that stores therein the toner, a stirring member that stirs the toner in the toner storage, a remaining toner amount detecting unit that detects the amount of the toner remaining in the toner storage, and a toner supplying unit that supplies the toner from a toner container to the toner storage based on the amount of the remaining toner. Furthermore, in the single component developing unit, it is known to provide a layer of sponge that is a porous body to the surface of the supplying roller, so that a sufficient amount of toner is carried and supplied to the developing roller, and the toner not used in the development can be well collected from the developing roller.

In such a single component developing unit, due to the stress applied to the toner stored in the toner storage during the repeated development process, additives sink into toner base resin, and cause the toner to deteriorate, such as reduction in flowability and chargeability of the toner. Before the toner is supplied, a large amount of deteriorated toner lies near the supplying roller in the toner storage. When new toner is supplied to the toner storage and the supplied toner with higher chargeability is brought into contact with the deteriorated toner with lower chargeability, the toner with higher chargeability is shifted to a higher charged state and the toner with lower chargeability is shifted to a lower charged state due to the interactions between the two. In this manner, bipolarization of the amounts of charge is accelerated. Therefore, reversely charged toner, charged to the polarity opposite to the normal polarity to which the toner should be charged, comes to occupy a larger ratio in the toner near the supplying roller. If such reversely charged toner is supplied to the developing roller by the supplying roller and conveyed to a developing section, the toner might be attached to a non-image area of a latent image carrier, and might result in scumming caused after the toner is supplied.

As a method for reducing scumming caused by an increase of the reversely charged toner after the toner is supplied, Japanese Patent Application Laid-open No. H11-237772 discloses a method for improving the stirred condition of supplied toner and deteriorated toner. In this technology, a stirring member is provided in the toner storage, so that the supplied toner and the deteriorated toner are stirred sufficiently. In this manner, the ratio of the reversely charged toner is reduced in the toner stored near the supplying roller, and the ratio of the reversely charged toner is reduced in the toner to be supplied to the developing roller.

However, not necessarily sufficient is the suppressing effect achieved simply by reducing the ratio of the reversely charged toner near the toner supplying roller using the stirring member included in the toner storage. In particular, when a supplying roller including a sponge layer is used, scumming tends to occur after the toner is supplied. Generally, the toner carried on the supplying roller is gradually replaced with the toner near the supplying roller along a toner flow generated by the rotation of the supplying roller. However, the supplying roller having a sponge layer has a stronger toner carrying capability than that of a supplying roller having a layer with an even surface, so that it is difficult to replace the toner carried by the supplying roller along the toner flow generated by the rotations of the supplying roller. Therefore, even if the ratio of the reversely charged toner is reduced in the toner near the supplying roller, it is difficult for the supplying roller to carry the toner and supply the toner to the developing roller. The supplying roller keeps carrying the deteriorated toner on the sponge layer; and the deteriorated toner carried by the supplying roller is brought into contact with the supplied toner, which causes the supplied toner to be charged to the reversed polarity. As a result, the toner with a high ratio of the reversely charged toner is supplied to the developing roller.

Japanese Patent Application Laid-open No. 2009-156951 discloses a developing unit including a toner removing member that removes toner from the sponge layer of the supplying roller. In the developing unit, the toner removing member having a blade-shaped end is disposed at a fixed position where the toner removing member is kept deeply inside the sponge layer. When the supplying roller is rotated during image formation, the toner removing member removes the toner carried on the surface of or in the sponge layer. In such a development unit, the toner carried in the sponge layer of the supplying roller is removed during image formation, and thereafter the sponge layer carries new toner.

However, because the developing unit disclosed in Japanese Patent Application Laid-open No. 2009-156951 has a structure that keeps the toner removing member digging into the sponge layer of the supplying roller, deterioration of the sponge layer is accelerated and the components become less durable, which is against the extended lifetime of the developing unit. Furthermore, because the blade-shaped toner removing member is disposed at a fixed position, the toner removed from the supplying roller might remain depending on the position where the removing member is disposed, whereby a flow of the entire toner in the toner storage is prevented and the stirring condition may be worsened.

The present invention is made in consideration of the above, and an object of the present invention is to provide a developing unit, an image forming apparatus, and a process cartridge that can reduce scumming caused by the toner after having been supplied, while suppressing deterioration of a toner supplying member.

SUMMARY OF THE INVENTION

It is an object of the present invention to at least partially solve the problems in the conventional technology.

According to an aspect of the present invention, there is provided a developing unit including: a developer carrier that carries toner to convey the toner to an opposing portion opposing a latent image carrier; a toner supplying member having a porous surface layer that is rotated while kept in contact with the developer carrier to supply the toner to the developer carrier and to collect toner not used in development from the developer carrier; a toner storage storing therein toner; a stirring member that is rotated to stir the toner in the toner storage; a toner amount detecting unit that detects an amount of the toner remaining in the toner storage; a toner supplying unit that supplies toner from a toner container storing therein new toner to the toner storage based on a detection result of the toner amount detecting unit; and a toner removing member that removes the toner carried in the porous surface layer of the toner supplying member, wherein the toner removing member is arranged in a separable and contactable manner from and with the porous surface layer of the toner supplying member, and the developing unit has a stirring mode in which the toner removing member is brought into contact with the porous surface layer, and the toner supplying member is rotated while the stirring member is rotated to stir the toner while the toner is supplied by the toner supplying unit.

According to another aspect of the present invention, there is provided a process cartridge including the developing unit mentioned above, wherein the latent image carrier and the developing unit are integrated into the process cartridge, and the process cartridge being removable from a main body of an image forming apparatus.

According to still another aspect of the present invention, there is provided an image forming apparatus including a process cartridge, wherein the process cartridge is a process cartridge mentioned above, wherein the latent image carrier and the developing unit are integrated into the process cartridge, and the process cartridge being removable from a main body of an image forming apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An exemplary embodiment of the present invention as a color image forming apparatus (hereinafter, simply referred to as an image forming apparatus) that is a type of image forming apparatuses is described below.

Figure 1:
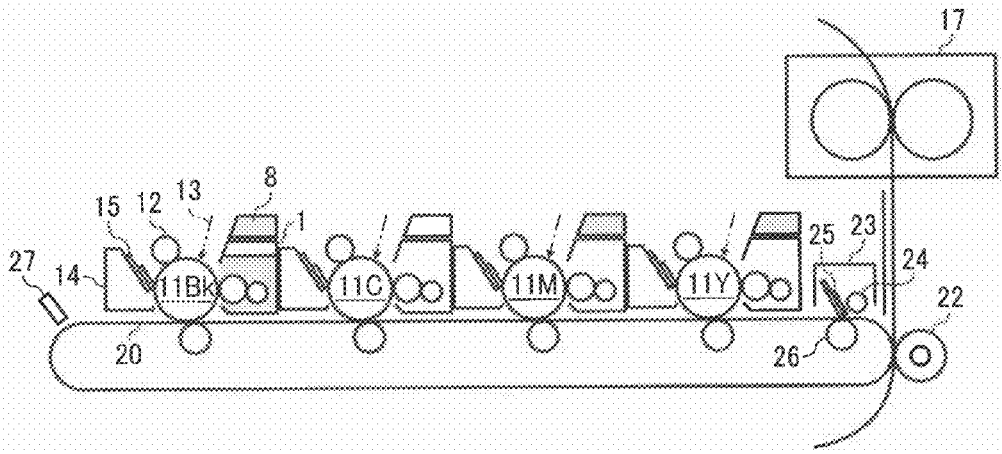
FIG. 1 is a schematic of a general structure of an image forming apparatus according to an embodiment of the present invention.

FIG. 1 is a schematic of a general structure of the image forming apparatus according to an embodiment of the present invention. This image forming apparatus is an image forming apparatus having a so-called tandem type intermediate transfer architecture. As illustrated in FIG. 1, four drum-shaped photosensitive elements 11Y, 11M, 11C, and 11Bk that are latent image carriers are arranged side by side. Each of the photosensitive elements 11Y, 11M, 11C, and 11Bk is rotatable in the clockwise direction in FIG. 1. A toner image forming unit for forming a toner image of each color of yellow, magenta, cyan, and black is arranged around each of the photosensitive elements 11Y, 11M, 11C, and 11Bk.

Because each of these toner image forming units has the same structure except for the color of the toner (color material) handled thereby, the differentiating signs Y, M, C, and Bk will be omitted below, and each of the toner image forming units is explained as a unit for a photosensitive element 11.

Sequentially arranged around the photosensitive element 11 are: a charging unit 12 that charges the surface of the photosensitive element 11 uniformly, an exposure 13 of a laser beam for forming a latent image on the surface thus charged uniformly, a developing unit 1 that forms a toner image by attaching charged toner to the latent image formed on the surface of the photosensitive element 11, and a cleaning unit 14 for removing toner remaining on the photosensitive element 11. A toner container 8 that is connected to the developing unit 1 and supplies toner to the developing unit 1 is disposed replaceably on top of the developing unit 1. In this embodiment, the photosensitive element 11, the charging unit 12, the developing unit 1, and the cleaning unit 14 included in the toner image forming unit are integrated as a process cartridge structured in a removable manner from the main body of the image forming apparatus. Such a structure using the process cartridge enables easy maintenance.

In FIG. 1, a charging technology using a contact roll is employed for the charging unit 12. According to the technology, a high voltage is applied to a core metal included in a charging roll arranged in contact with the photosensitive element 11, and charges the surface of the photosensitive element 11 uniformly. However, the charging unit 12 is not limited thereto, and a corotron or a scorotron discharged by applying a high voltage to a charging wire, a charging brush, a charging sheet, or a needle electrode may be used instead. Because these technologies allow the surface of the photosensitive element 11 to be charged without contacting the photosensitive element 11, they are less affected by cleaning properties, advantageously. However, because these technologies generate much more corona products, such as ozone or NOx, in a discharge comparing with a technology using a charging roll, these technologies have a disadvantage in view of durability of the photosensitive element 11.

An intermediate transfer belt 20 is disposed under the photosensitive elements 11Y, 11M, 11C, and 11Bk. The intermediate transfer belt 20 is stretched across stretching rollers not illustrated, and driven in counterclockwise direction in FIG. 1. Primary transfer rollers 21Y, 21M, 21C, and 21Bk are arranged at positions opposing the photosensitive elements 11Y, 11M, 11C, and 11Bk, respectively, across the intermediate transfer belt 20 so as to transfer the toner image formed on the photosensitive elements 11Y, 11M, 11C, and 11Bk onto the intermediate transfer belt 20.

A secondary transfer roller 22, kept in contact with the circumferential surface of the intermediate transfer belt 20 to transfer the toner image formed on the intermediate transfer belt 20 onto a transfer medium, is disposed downstream of the primary transfer rollers 21Y, 21M, 21C, and 21Bk in the rotating direction of the intermediate transfer belt 20. A belt cleaning unit 23, for removing the residual toner remaining on the intermediate transfer belt 20 after the toner image is transferred by the secondary transfer roller 22, is disposed at a position further downstream of the secondary transfer roller 22. The belt cleaning unit 23 includes a cleaning brush 24 and a cleaning blade 25 made of urethane rubber. The cleaning blade 25 is kept in contact with the intermediate transfer belt 20 in a counter-direction of rotating direction of the intermediate transfer belt 20; and a metallic cleaning facing roller 26 is disposed opposing the cleaning blade 25. The toner removed by the cleaning blade 25 is conveyed by, for example, a coil not illustrated, and collected in a spent toner storage not illustrated. A sensor 27, for measuring the amount of transferred toner attached to the intermediate transfer belt 20 and for measuring the position of each of the colors so as to be used for adjusting the image density or alignment, is disposed downstream of the primary transfer rollers 21Y, 21M, 21C, and 21Bk and upstream of the secondary transfer roller 22. In this example, an optical sensor that is a combination of a regular reflector and a diffuse reflector is used.

In an image forming apparatus having such a structure, the toner image formed in each of the colors on the respective photosensitive elements 11Y, 11M, 11C, and 11Bk is sequentially transferred onto the intermediate transfer belt 20 so as to form a four-colored superimposed image. In synchronization with the operational timing at which the leading edge of the four-colored superimposed image formed on the intermediate transfer belt 20 arrives at the secondary transfer nip, a paper feeding unit not illustrated feeds transfer paper that is a transfer medium, and the superimposed image is transferred onto the transfer paper by the secondary transfer roller 22. The four-colored superimposed image transferred onto the transfer paper is conveyed to a fixing unit 17 and fixed by the fixing unit 17; and the transfer paper is discharged by a discharging roller not illustrated.

Figure 2:
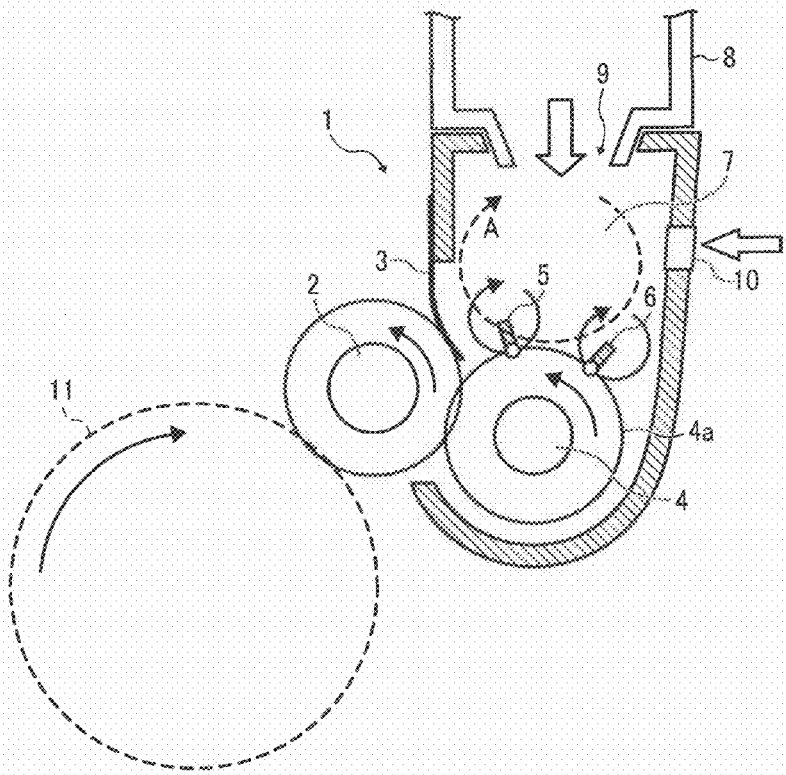
FIG. 2 is a schematic of a general structure of a developing unit.

FIG. 2 is a sectional view of a general structure of the developing unit 1. The developing unit 1 includes a developing roller 2 that is a developer carrier for carrying the toner as a developer and is rotated in the counterclockwise direction in FIG. 2 to carry the developer to a developing section opposing the photosensitive element 11. The developing unit 1 also includes a supplying roller 4 that is kept in contact with the developing roller 2 and is rotated to supply the toner to the developing roller 2, a controlling member 3 that controls the amount of the toner so that a thin layer of the toner is formed on the developing roller 2, and a toner storage 7 that stores therein the toner. In the toner storage 7, two stirring members 5 and 6 are disposed as stirring means for stirring to loosen the toner in the toner storage 7.

During image formation, the stirring members 5 and 6 are driven to rotate in the clockwise direction in FIG. 2 to stir and loosen the toner in the toner storage 7. As the toner in the toner storage 7 is loosened, the toner starts to come closer to the supplying roller 4 located below by its own weight. The supplying roller 4 carrying the toner is rotated in the counterclockwise direction in FIG. 2 to carry the toner to an abutting portion kept in contact with the developing roller 2, and supplies the toner to the developing roller 2, as well as collecting the toner from the developing roller 2. The supplying roller 4 and the developing roller 2 rotate in reverse directions at the abutting portion. At an upstream portion of the abutting portion in the rotating direction of the developing roller 2, the supplying roller 4 rubs off the toner remaining without being developed on the photosensitive element 11 from the developing roller 2 to collect the toner. At a portion downstream of the abutting portion, the toner carried on the supplying roller 4 is moved to the developing roller 2. In the developing unit illustrated in FIG. 2, because the developing roller 2, the supplying roller 4, and the stirring members 5 and 6 are rotated in the manner described above, the toner in the toner storage 7 circulates in the direction of the arrow A illustrated in FIG. 2.

In the developing unit 1, a roller including a rotating shaft (core metal) covered with foamed material with holes (sponge) is used as the supplying roller 4, and the supplying roller 4 includes a sponge layer 4*a* that is a porous surface layer. Because the supplying roller 4 having such a structure can carry the toner on the surface of and inside of the sponge layer 4*a*, a sufficient amount of toner can be conveyed to the abutting portion kept in contact with the developing roller 2. In addition, the sponge layer 4*a* rotating in the reverse direction can rub off the toner well from the developing roller 2 after the development. Moreover, a stress applied to the toner, attributable to the pressure at the abutting portion kept in contact with the developing roller 2, can be reduced to prevent toner deterioration. A conductive or ion-conductive material containing fine particles of carbon is used as the formed material. Accordingly, a supplying bias can be applied to the rotating shaft of the supplying roller 4 so that a sufficient amount of toner is supplied from the sponge layer 4*a* of the supplying roller 4 to the developing roller 2. A direct current (DC) bias or an alternating current (AC) bias superimposed onto a DC bias is used as the supplying bias.

A roller covered with a rubber layer is used as the developing roller 2; and a surface coating layer made of a material easily chargeable to a reverse polarity to the polarity of the toner is formed on the surface of the rubber layer. The rubber layer has stiffness equal to or less than 60 degrees according to JIS-A so as to prevent toner deterioration caused by the pressure applied to the toner at the abutting portion kept in contact with the controlling member 3. The roughness of the surface is set between 0.3 to 2.0 micrometers in the arithmetic average roughness Ra, so that a required amount of toner is retained on the surface. Because a developing bias for generating an electrical field between the developing roller 2 and the photosensitive element 11 is applied to the developing roller 2, the resistance of the rubber layer is set to a certain level.

The controlling member 3 is a plate spring made of a metal such as stainless steel or phosphor bronze. The free end of the controlling member 3 is kept in contact with the surface of the developing roller 2 at a predetermined pressure. The toner passing through a pressing section is formed into a thin layer, and charged by triboelectric charging. Moreover, a DC bias that is offset in the same direction as the polarity of the charged developer with respect to the developing bias or an AC bias superimposed onto a DC bias that is offset in the same direction as the polarity of the charged developer with respect to the developing bias is applied to the controlling member 3 to assist the triboelectric charging.

The toner supplied to the developing roller 2 and formed into a thin layer by the controlling member 3 is conveyed to a developing section opposing the photosensitive element 11, and the image is developed by the electrical field generated between the developing bias applied to the developing roller 2 and the electrostatic latent image formed on the photosensitive element 11. The toner, remaining on the developing roller 2 without being developed onto the photosensitive element 11, is returned into the toner storage 7 by the rotation of the developing roller, and rubbed off from the developing roller 2 by the supplying roller 4 as described above. FIG. 2 depicts an example of a contact-based development technology in which the photosensitive element 11 is kept in contact with the developing roller 2. However, the development technology may be a non-contact one in which the photosensitive element 11 and the developing roller 2 are arranged in a non-contact manner.

On top of the developing unit 1, the toner container 8, storing therein new toner to be supplied to the toner storage 7, is disposed replaceably. On the wall of the toner storage 7 included in the developing unit 1, a detection window 10 made of a transparent material is provided, so that the amount of the toner remaining in the toner storage 7 can be detected. The image forming apparatus corresponding to the detection window 10 has an optical remaining toner amount detecting sensor (not illustrated) that detects the amount of the remaining toner through the detection window 10. An example of the optical remaining toner amount detecting sensor includes a transmission-based sensor having a light-emitting element outputting light to the detection window 10 and a light-receiving element that receives the light passed through the detection window 10. As another example of the remaining toner amount detecting sensor, a piezoelectric sensor or the like may be used to detect the amount of the remaining toner directly. If the detection result of the remaining toner amount detecting sensor indicates that the amount of the toner remaining in the toner storage 2 is insufficient, toner is supplied to the toner storage 7 from the toner container 8 through a toner supplying opening 9 that is a portion communicating to the developing unit 1. Alternatively, a dot counter may be provided and triggered at the timing of a detection of the remaining toner amount detecting sensor, and the amount of toner consumption can be calculated based on the dot count, so that the amount of the remaining toner can be determined to be insufficient when the amount of the remaining toner is further reduced in the developing unit 1 to supply toner.

As a means for supplying toner, for example, a toner conveying unit not illustrated, such as a screw or a coil, may be provided in the toner container 8 so as to carry the toner to the toner supplying opening 9 and to supply the toner to the toner storage 7. The amount of the toner to be supplied can be controlled by the length of time for which the toner conveying unit is driven. Furthermore, when the toner container 8 no longer has any toner to supply, an end-of-toner indicator is turned on in a display panel not illustrated in the image forming apparatus, which will prompt the user to replace the toner container 8.

Characteristics of this embodiment will now be explained.

Figure 3:
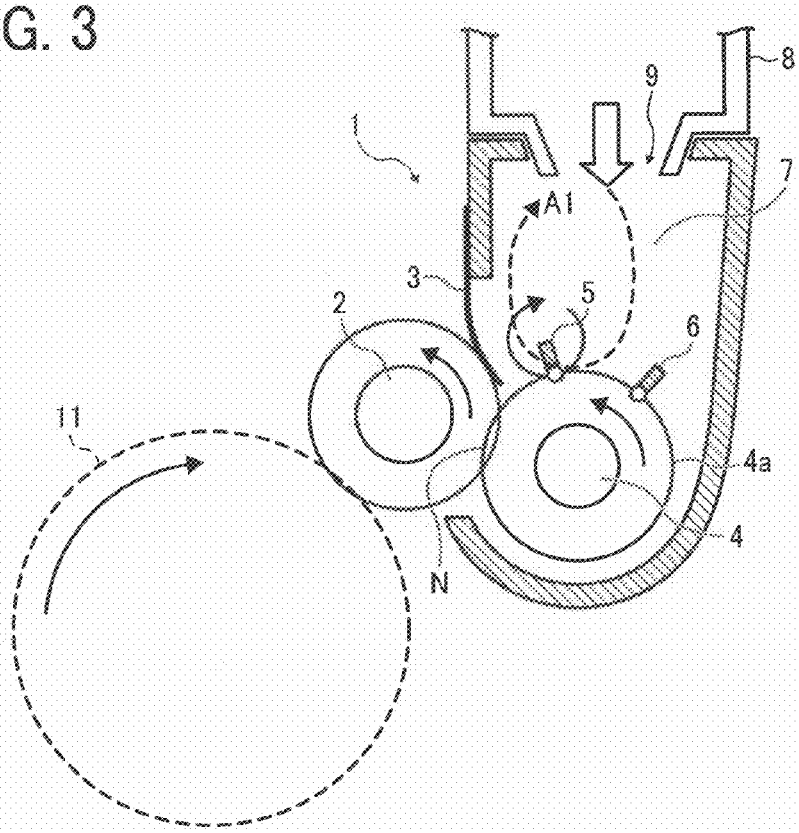
FIG. 3 is a schematic of the developing unit in a stirring mode when toner is supplied.

FIG. 3 is a schematic of a configuration of the developing unit according to the embodiment while the toner is supplied. In the developing unit 1 according to the embodiment, during a toner supplying process in which the remaining toner amount detecting sensor detects a shortage in the amount of the toner remaining in the toner storage 7 and toner is supplied from the toner container 8, one stirring member 6 is stopped in a manner kept in contact with the sponge layer 4*a* of the supplying roller 4. At this time, the developing roller 2, the supplying roller 4, and the stirring member 5 are rotated. In this manner, the flow of the toner in the toner storage 7 changes from the circulation in the direction of the arrow A illustrated in FIG. 2 to the circulation in the direction of the arrow A1 illustrated in FIG. 3. In this manner, while the toner is supplied, because the stirring member 5 is rotated while the stirring member 6 is kept still, the supplied toner supplied via the toner supplying opening 9 comes closer to the supplying roller 4, and is mixed and stirred with the deteriorated toner. By keeping the stirring member 5 in rotation, even if the amount of reversely charged toner is increased, the ratio of the reversely charged toner near the supplying roller 4 can be reduced. This configuration is called a stirring mode upon supplying the toner.

Figure 4:
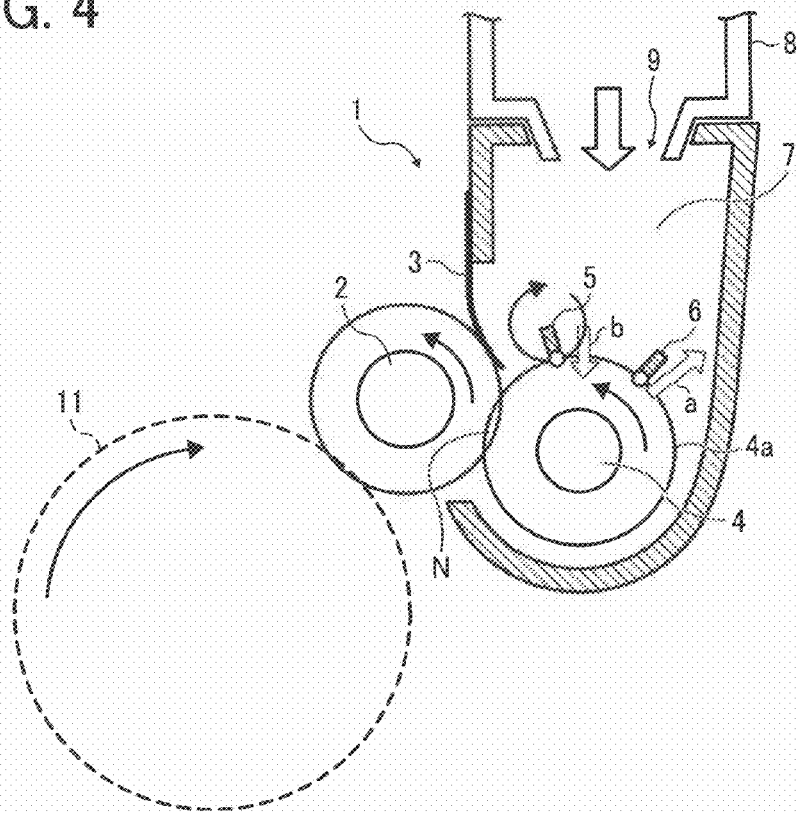
FIG. 4 is a schematic for explaining the movement of toner with respect to a supplying roller in the stirring mode when toner is supplied.

FIG. 4 is a schematic for explaining the movement of toner with respect to the supplying roller 4 in the stirring mode upon supplying the toner. The stirring member 6 kept, still while kept in contact with the rotating supplying roller 4, rubs off the toner carried on the surface of the sponge layer 4*a*. In addition, the leading edge of the stirring member 6 digging into inside of the rotating supplying roller 4 loosens the deteriorated toner clogged inside the sponge layer 4*a* of the supplying roller 4 so as to allow the deteriorated toner to be easily removed from the supplying roller 4 (arrow a). The toner thus removed is stirred with the supplied toner in the toner storage 7 to facilitate mixing of the deteriorated toner with the supplied toner. Furthermore, because the stirring member 5 keeps rotating at a position downstream of the stirring member 6 in the rotating direction of the supplying roller 4, the supplied toner supplied via the toner supplying opening 9 comes closer to the supplying roller 4 so as to reduce the ratio of the reversely charged toner in the entire toner. Therefore, the sponge layer 4*a* from which the deteriorated toner is removed by the stirring member 5 at the upstream can carry the toner with a smaller ratio of the reversely charged toner (arrow b). The toner with a smaller ratio of the reversely charged toner carried in the supplying roller 4 is carried to a supplying nip N which is kept in contact with the developing roller 2, and is supplied to the developing roller 2.

In this manner, when the toner is supplied, the supplying roller 4 is rotated while the stirring member 6, which is rotated during image formation, is kept still in contact with the sponge layer 4*a*, and the stirring member 6 can thus function as a toner removing member for removing the toner carried in the sponge layer 4*a*. In this manner, when the toner is supplied, the supplying roller 4 can be refreshed, so that the toner carried by the supplying roller 4 can be replaced with the toner with a smaller ratio of the reversely charged toner. Therefore, scumming caused by the toner after having been supplied can be suppressed. Furthermore, during image formation, the stirring member 6 is used as a toner removing member by being rotated and brought into contact with the sponge layer 4*a* intermittently. Therefore, the deterioration of the sponge layer 4*a* can be suppressed, compared with a structure in which a toner removing member is fixed at a position that is always held digging into inside of the sponge layer 4*a*.

Figure 5A:
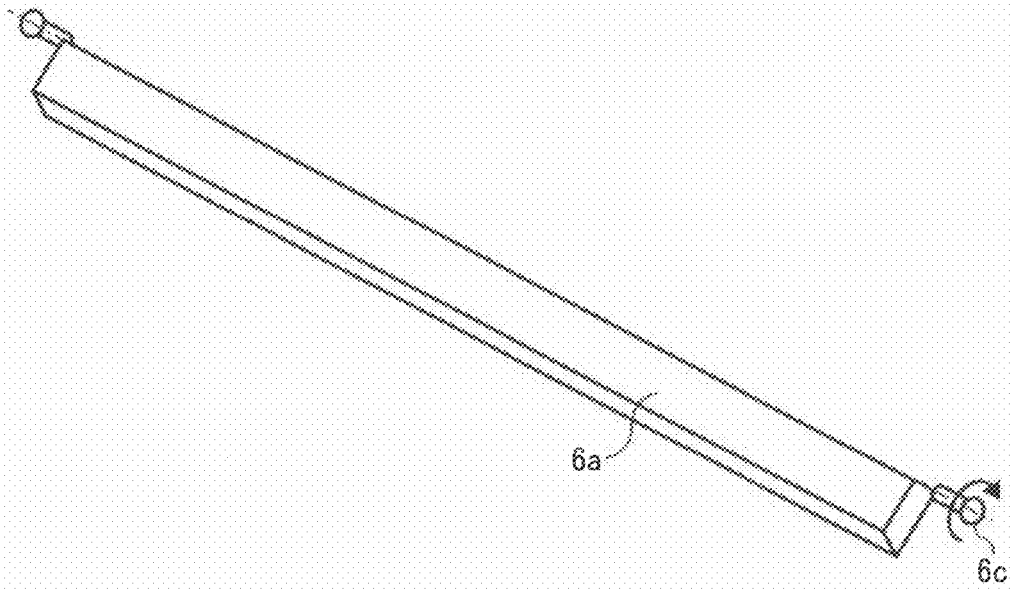
FIGS. 5A and 5B are perspective views each depicting a shape of a stirring member.
Figure 5B:
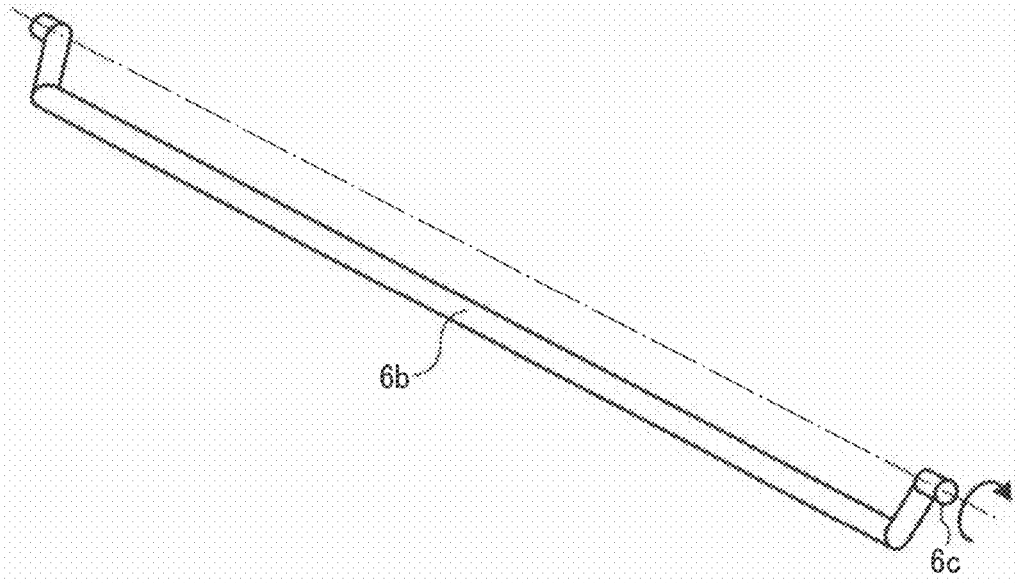

FIGS. 5A and 5B are perspective views each depicting a shape of the stirring member 6. In the example illustrated in FIG. 5A, a puddle 6*a* is placed on a rotating axis 6*c*. The rotating axis 6*c* is arranged in parallel with the rotating axis direction of the supplying roller 4 so that the outermost rotating trajectory of the puddle 6*a* is kept in contact with the sponge layer 4*a* of the supplying roller 4. Alternatively, the stirring member 6 may have the structure with shafts 6*b* arranged on the rotating axis 6*c* in the manner illustrated in FIG. 5B, considering the torque applied thereto and the flow of the toner in the toner storage 7.

Figure 6A:
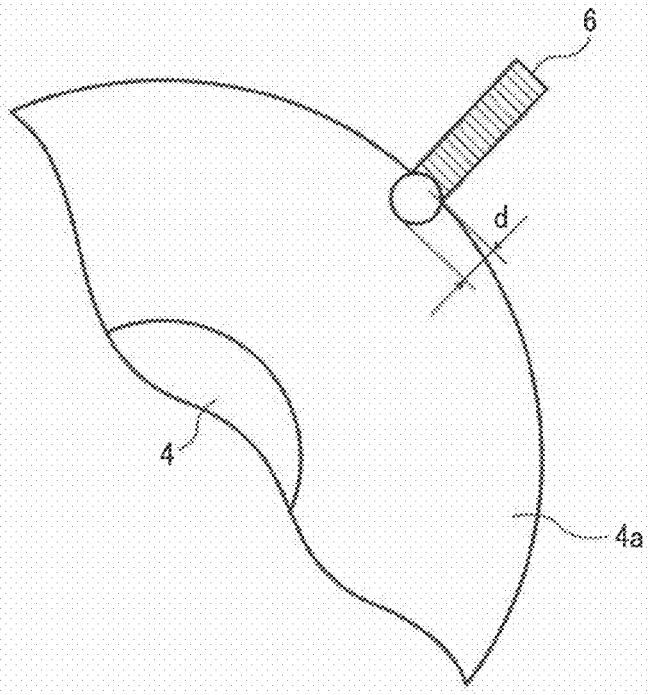
FIGS. 6A and 6B are schematics for explaining how a toner removing member is kept in contact in the stirring mode.
Figure 6B:
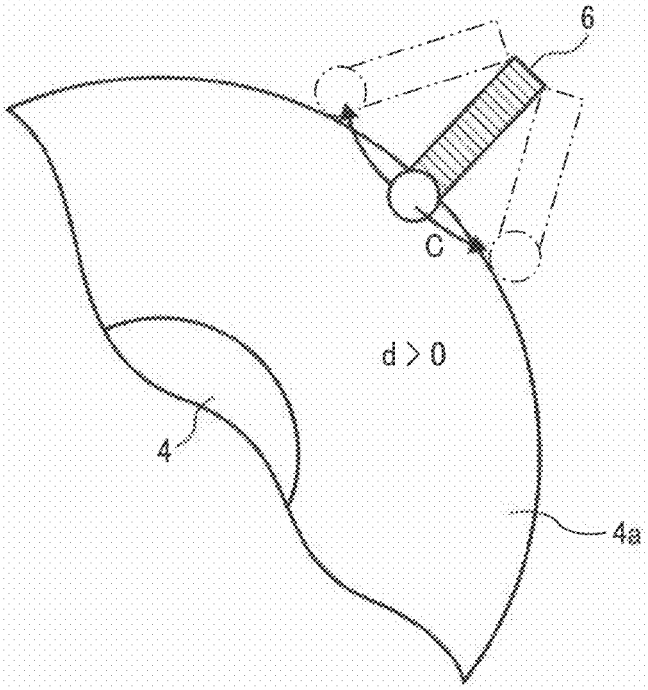

FIGS. 6A and 6B are schematics for explaining how the stirring member 6 is brought into contact with the sponge layer in the stirring mode. In the stirring mode, when the toner is supplied, the stirring member 6 needs to be kept still in contact with the sponge layer 4*a* of the supplying roller 4, and the amount d by which the stirring member 6 is held inside of the sponge layer 4*a* of the supplying roller 4 must be larger than 0. In particular, even if toner is clogged inside of the sponge layer 4*a*, the toner can easily be removed as long as the stirring member 6 is kept inside of the sponge layer 4*a* of the supplying roller 4 by a certain length as illustrated in FIG. 6A. Moreover, the stirring member 6 may be placed at any position within the range indicated by the arrow c illustrated in FIG. 6B as long as d>0 is satisfied as illustrated in FIG. 6B. The amount d of the stirring member 6 getting inside of the sponge layer 4*a* may be determined depending on the size of the developing unit 1, the torque applied thereto, and the like.

The results of effectiveness validated in an experiment will be described below.

The toner used in the experiment is as specified as follows:

| | |
|---|---|
| Polyester resin A (with a softening point at 131 degrees Celsius and an acid value of 25) | 68 parts |
| Polyester resin B (with a softening point at 116 degrees Celsius and an acid value of 1.9) | 32 parts |
| Cyan masterbatch (containing 50 parts of pigment blue 15:3) | 8 parts |
| Carnauba wax | 8 parts |

These toner materials were mixed sufficiently in a Henschel mixer, and melt-kneaded in a twin-screw extruding and kneading machine having a discharging unit removed (PCM-30 manufactured by IKEGAI Corporation). The mixture thus obtained is rolled out with a cold press roller into a thickness of two millimeters, cooled on a cooling belt, and crushed coarsely in a feather mill. The mixture was then further crushed into powder having an average granular diameter between 10 to 12 micrometers in a mechanical mill (KTM manufactured by Kawasaki Heavy Industries, Ltd.), and was further crushed in a jet mill (IDS manufactured by Nippon Pneumatic Mfg. Co., Ltd.) while coarsely classifying the powder. The powder was then finely classified with a rotary classifier (Teeplex classifier type 100ATP manufactured by Hosokawa Micron Corporation) to obtain a toner base A having a mean volume diameter of 7.9 micrometers and an average circularity of 0.910. One part of silica (RX200) was added to 100 parts of the toner base A, and the mixture was mixed in a Henschel mixer for five minutes at a circumferential speed of 40 meters/sec to produce toner.

Figure 7:
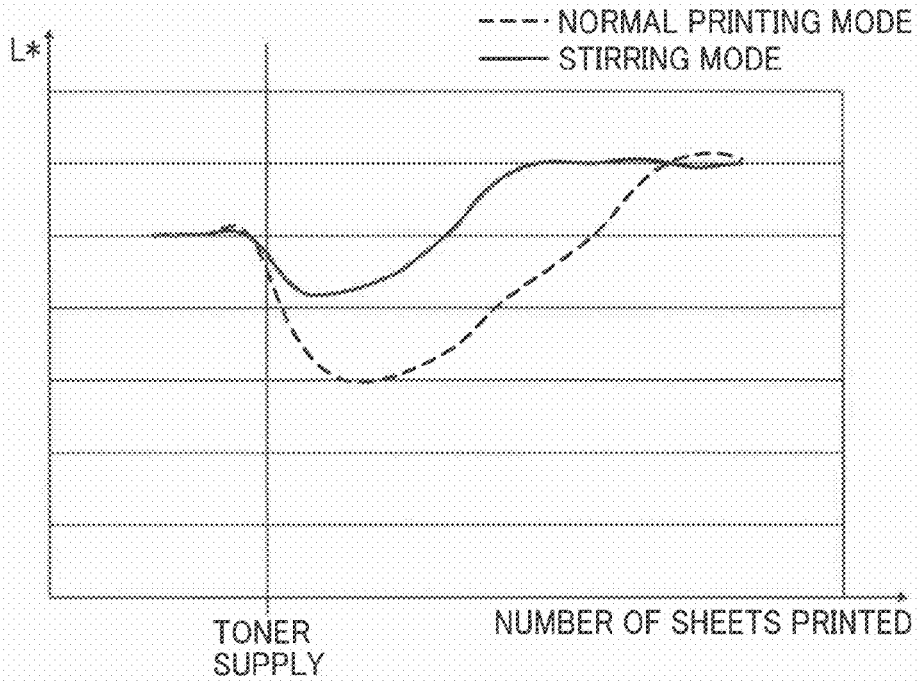
FIG. 7 is a graph indicating levels of scumming caused by the toner after having been supplied.

The toner thus created was supplied to a Ricoh's Ipsio C220. After performing a durability test of one sheet per job and a three-second intermission over 3000 sheets and 5000 sheets at a normal temperature, the toner in the developing unit 1 was collected. The expected toner remaining in the developing unit at the time of detection of the end-of-toner was considered to be deteriorated toner. New toner was then supplied to the developing unit 1 filled with deteriorated toner, and the amounts of toner causing scumming on the photosensitive element 11 at the time of image formation were compared. FIG. 7 is a graph indicating levels of scumming caused after the toner is supplied. In FIG. 7, the horizontal axis corresponds to the number of sheets printed, and the vertical axis corresponds to the color density of the surface. Lightness L* is used as the index of color density. A larger value of L* indicates a color closer to white, which means that the scumming condition is good. In FIG. 7, the transitions of the scumming are compared between the scumming caused by the toner after having been supplied while stirring the toner during image formation in the configuration of the developing unit 1 illustrated in FIG. 2, and the scumming caused after the toner is supplied in the stirring mode of the developing unit according to the embodiment illustrated in FIG. 3. According to this graph, it can be concluded that an increase of the scumming caused immediately after supplying the toner is alleviated by using the stirring mode according to the embodiment, and the number of sheets required for the scumming to recover to a normal condition by continuing image formation is reduced. Therefore, using the stirring mode can alleviate the scumming caused after the toner is supplied and provide better image quality.

Figure 8:
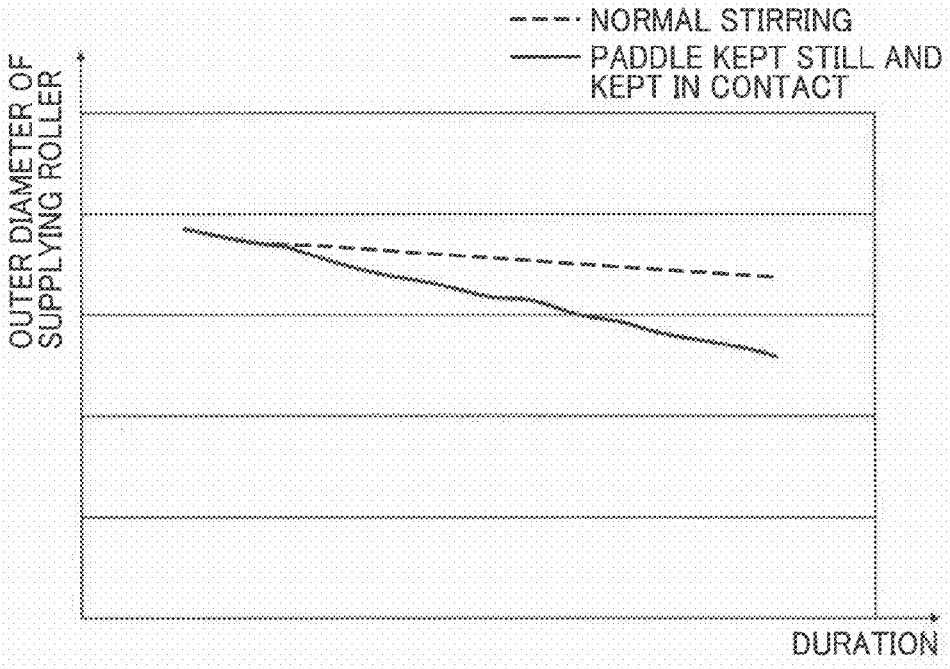
FIG. 8 is a graph of evaluation results of the durability of the supplying roller with the toner removing member kept rotated and of the supplying roller with the toner removing member kept still.

FIG. 8 is a graph of evaluation results of the durability of the supplying roller 4 with the stirring member 6, which is the toner removing member, kept rotated and kept still. More specifically, toner was filled in the developing unit 1, the supplying roller 4 was kept running in idle with the stirring member 6 rotated in a normal stirring mode, and with the stirring member 5 kept still in contact with the supplying roller 4 in a stirring mode to evaluate the durability of the supplying roller 4, and the amount of changes in the outer diameter of the supplying roller 4 was compared. The diameter of the supplying roller 4 kept in contact was reduced more, which means that the outer form was worn out because of the contact. Therefore, the durability of the supplying roller 4 can be improved by rotating the stirring member 6 during image formation.

In the embodiment, the present invention is explained using an exemplary structure including the two stirring members 5 and 6 as stirring units in the toner storage 7, and using one stirring member 6 as a toner removing member for removing the toner carried in the supplying roller 4 while toner is supplied. However, the present invention is not limited thereto, and a separate member may be arranged on the supplying roller 4 in a contactable and separable manner as a toner removing member, and toner may be removed by bringing the toner removing member in contact with the supplying roller 4 in the stirring mode while the toner is supplied.

According to the embodiment, the developing unit 1 includes the developing roller 2 that is a developer carrier; the supplying roller 4 that is a toner supplying member having the sponge layer 4*a* that is a porous surface layer being rotated while being kept in contact with the developing roller 2 to supply toner to the developing roller 2 and to collect the toner not used in development from the developing roller 2; the toner storage 7 storing therein toner; the stirring member 5 that is rotated to stir the toner in the toner storage 7; a toner amount detecting unit that detects the amount of the toner remaining in the toner storage 7; a toner supplying unit that supplies toner from the toner container 8 storing therein new toner to the toner storage 7 based on a detection result of the toner amount detecting unit; and the stirring member 6 that is a toner removing member for removing the toner carried in the sponge layer 4*a* of the supplying roller 4. The stirring member 6 is arranged in a separable and contactable manner from and with the sponge layer 4*a* of the supplying roller 4, the developing unit 1 operates in the stirring mode in which the stirring member 6 is brought into contact with the sponge layer 4*a*, and the supplying roller 4 is rotated while the stirring member 5 is rotated to stir the toner during the time the toner supplying unit supplies the toner. In this manner, toner scumming caused after the toner is supplied can be reduced, while suppressing deterioration of the supplying roller.

Furthermore, according to the embodiment, the stirring member 6 that is a toner removing member is rotated about an axis laid in parallel with the supplying roller 4 and has a rotational trajectory kept in contact with the sponge layer 4*a*. The stirring member 6 is kept still in contact with the sponge layer 4*a* in the stirring mode. In this manner, the stirring member 6 can be arranged in a separable and contactable manner from and with the sponge layer 4*a*, and the stirring member 6 can be brought into contact with the sponge layer 4*a* in the stirring mode with a simple structure. Furthermore, because the stirring member 6 is rotatable, the flow of the entire toner in the toner storage 7 is not interrupted, and the stirring condition will not be worsened.

Furthermore, according to the embodiment, the developing unit 1 includes the stirring members 5 and 6 as stirring members for stirring the toner in the toner storage 7. The stirring member 6 is used as a toner removing member as well in the stirring mode. In this manner, the number of components can be reduced further so as to reduce cost and to save space.

Furthermore, the stirring member 6, functioning as a toner removing member when the toner is supplied, is positioned upstream; and the stirring member 5, caused to rotate while the toner is supplied, is positioned downstream in the rotating direction of the supplying roller 4. Therefore, the sponge layer 4*a*, having toner removed by the stirring member 6 and refreshed in the upstream, carries the toner with a smaller ratio of reversely charged toner stirred by the stirring member 5, so that the toner carried by the supplying roller 4 can be replaced more efficiently.

Furthermore, according to the embodiment, the stirring members 5 and 6 are driven to rotate during image formation to stir the toner in the toner storage 7. Therefore, the flowability of the toner can be improved, which enables higher image quality to be achieved.

Furthermore, according to the embodiment, an image forming apparatus including a photosensitive element that carries a latent image and a developing unit for developing the latent image formed on the photosensitive element can provide high quality images by using the developing unit 1 as a developing unit.

Furthermore, according to the embodiment, maintenance can be simplified by using a process cartridge in which the photosensitive element is integrated at least with the developing unit 1 and that is removable from the image forming apparatus main body.

According to the present invention, while the toner is supplied, the toner removing member is kept in contact with the porous surface layer, and the toner supplying member is rotated. The toner carried in the porous body can be thus removed. Furthermore, because the stirring members are rotated to stir the toner in the toner storage, the uneven distribution of the reversely charged toner near the supplying roller can be evened out so as to reduce the ratio of the reversely charged toner contained therein. In this manner, by refreshing the porous surface layer of the toner supplying member so as to make the porous surface layer newly carry the toner near the supplying roller before supplying the toner, the toner carried by the porous surface layer can be replaced with the toner containing the reversely charged toner in a smaller ratio. Therefore, toner scumming caused by the toner after having been supplied can be suppressed. Furthermore, the toner removing member is structured in a separable and contactable manner from and with the porous surface layer, and is made separated as required while no toner is supplied. Therefore, the deterioration of the porous surface layer caused by the toner removing member can be suppressed, while reducing toner scumming caused by the toner after having been supplied.

According to the present invention, toner scumming caused by the toner after having been supplied can be reduced advantageously, while suppressing the deterioration of the toner supplying member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing unit comprising:

a developer carrier that carries toner to convey the toner to an opposing portion opposing a latent image carrier;

a toner supplying member having a porous surface layer that is rotated while kept in contact with the developer carrier to supply the toner to the developer carrier and to collect toner not used in development from the developer carrier;

a toner storage storing therein toner;

a stirring member that is rotated to stir the toner in the toner storage;

a toner amount detecting unit that detects an amount of the toner remaining in the toner storage;

a toner supplying unit that supplies toner from a toner container storing therein new toner to the toner storage based on a detection result of the toner amount detecting unit; and a toner removing member that removes the toner carried in the porous surface layer of the toner supplying member, wherein the toner removing member is arranged in a separable and contactable manner from and with the porous surface layer of the toner supplying member, and the developing unit has a stirring mode in which the toner removing member is brought into contact with the porous surface layer, the toner removing member includes a mode in which the toner removing member is stationary and stays in contact with the porous surface layer of the toner supplying member, as the toner supplying member is rotated, and the toner supplying member is rotated while the stirring member is rotated to stir the toner while the toner is supplied by the toner supplying unit.

2. The developing unit according to claim 1, wherein
the toner removing member is arranged to rotate about an axis laid in parallel with the toner supplying member, and has a rotational trajectory kept in contact with the porous surface layer, and
in the stirring mode, the toner removing member is kept still in contact with the porous surface layer.

3. The developing unit according to claim 1, wherein
the stirring member comprises a plurality of stirring members, and
in the stirring mode, at least one of the stirring members is kept still in contact with the porous surface layer so as to function as the toner removing member.

4. The developing unit according to claim 1, wherein
the toner removing member is arranged at an upstream portion of the toner supplying member,
the stirring member is caused to rotate while the toner is supplied, and
the stirring member is arranged at a downstream portion in a rotating direction of the toner supplying member.

5. The developing unit according to claim 3, wherein
a plurality of the stirring members is driven to rotate during image formation.

6. The developing unit according to claim 4, wherein
a plurality of the stirring members is driven to rotate during image formation.

7. A process cartridge comprising a developing unit, wherein
the developing unit includes:
a developer carrier that carries toner to convey the toner to an opposing portion opposing a latent image carrier;
a toner supplying member having a porous surface layer that is rotated while kept in contact with the developer carrier to supply the toner to the developer carrier and to collect toner not used in development from the developer carrier;
a toner storage storing therein toner;
a stirring member that is rotated to stir the toner in the toner storage;
a toner amount detecting unit that detects an amount of the toner remaining in the toner storage;
a toner supplying unit that supplies toner from a toner container storing therein new toner to the toner storage based on a detection result of the toner amount detecting unit; and
a toner removing member that removes the toner carried in the porous surface layer of the toner supplying member, wherein
the toner removing member is arranged in a separable and contactable manner from and with the porous surface layer of the toner supplying member,
the developing unit has a stirring mode in which
the toner removing member is brought into contact with the porous surface layer,
the toner removing member includes a mode in which the toner removing member is stationary and stays in contact with the porous surface layer of the toner supplying member, as the toner supplying member is rotated, and
the toner supplying member is rotated while the stirring member is rotated to stir the toner while the toner is supplied by the toner supplying unit,
the latent image carrier and the developing unit are integrated into the process cartridge, and
the process cartridge is removable from a main body of an image forming apparatus.

8. The process cartridge according to claim 7, wherein
the toner removing member is arranged to rotate about an axis laid in parallel with the toner supplying member, and has a rotational trajectory kept in contact with the porous surface layer, and
in the stirring mode, the toner removing member is kept still in contact with the porous surface layer.

9. The process cartridge according to claim 7, wherein
the stirring member comprises a plurality of stirring members, and
in the stirring mode, at least one of the stirring members is kept still in contact with the porous surface layer so as to function as the toner removing member.

10. The process cartridge according to claim 7, wherein
the toner removing member is arranged at an upstream portion of the toner supplying member,
the stirring member is caused to rotate while the toner is supplied, and
the stirring member is arranged at a downstream portion in a rotating direction of the toner supplying member.

11. The process cartridge according to claim 9, wherein
a plurality of the stirring members is driven to rotate during image formation.

12. The process cartridge according to claim 10, wherein
a plurality of the stirring members is driven to rotate during image formation.

13. An image forming apparatus comprising a process cartridge, wherein
the process cartridge includes:
a developer carrier that carries toner to convey the toner to an opposing portion opposing a latent image carrier;
a toner supplying member having a porous surface layer that is rotated while kept in contact with the developer carrier to supply the toner to the developer carrier and to collect toner not used in development from the developer carrier;
a toner storage storing therein toner;
a stirring member that is rotated to stir the toner in the toner storage;
a toner amount detecting unit that detects an amount of the toner remaining in the toner storage;
a toner supplying unit that supplies toner from a toner container storing therein new toner to the toner storage based on a detection result of the toner amount detecting unit; and
a toner removing member that removes the toner carried in the porous surface layer of the toner supplying member, wherein
the toner removing member is arranged in a separable and contactable manner from and with the porous surface layer of the toner supplying member,
the developing unit has a stirring mode in which
the toner removing member is brought into contact with the porous surface layer,
the toner removing member includes a mode in which the toner removing member is stationary and stays in contact with the porous surface layer of the toner supplying member, as the toner supplying member is rotated, and
the toner supplying member is rotated while the stirring member is rotated to stir the toner while the toner is supplied by the toner supplying unit,
the latent image carrier and the developing unit are integrated into the process cartridge, and
the process cartridge is removable from a main body of an image forming apparatus.

14. The image forming apparatus according to claim 13, wherein, the toner removing member is arranged to rotate about an axis laid in parallel with the toner supplying member, and has a rotational trajectory kept in contact with the porous surface layer, and in the stirring mode, the toner removing member is kept still in contact with the porous surface layer.

15. The image forming apparatus according to claim 13, wherein, the stirring member comprises a plurality of stirring members, and in the stirring mode, at least one of the stirring members is kept still in contact with the porous surface layer so as to function as the toner removing member.

16. The image forming apparatus according to claim 13, wherein, the toner removing member is arranged at an upstream portion of the toner supplying member, the stirring member is caused to rotate while the toner is supplied, and the stirring member is arranged at a downstream portion in a rotating direction of the toner supplying member.

17. The image forming apparatus according to claim 15, wherein, a plurality of the stirring members is driven to rotate during image formation.

18. The image forming apparatus according to claim 16, wherein, a plurality of the stirring members is driven to rotate during image formation.

* * * * *